US007875131B2

(12) United States Patent
Pandey

(10) Patent No.: US 7,875,131 B2
(45) Date of Patent: Jan. 25, 2011

(54) $L1_2$ STRENGTHENED AMORPHOUS ALUMINUM ALLOYS

(75) Inventor: Awadh B. Pandey, Jupiter, FL (US)

(73) Assignee: United Technologies Corporation, Hartford, CT (US)

( * ) Notice: Subject to any disclaimer, the term of this patent is extended or adjusted under 35 U.S.C. 154(b) by 296 days.

(21) Appl. No.: 12/148,458

(22) Filed: Apr. 18, 2008

(65) Prior Publication Data

US 2009/0263266 A1 Oct. 22, 2009

(51) Int. Cl.
*C22C 45/08* (2006.01)

(52) U.S. Cl. ..... 148/403; 148/437; 420/550; 420/551

(58) Field of Classification Search ..... 148/403
See application file for complete search history.

(56) References Cited

U.S. PATENT DOCUMENTS

| | | | | |
|---|---|---|---|---|
| 3,619,181 | A | | 11/1971 | Willey |
| 3,816,080 | A | | 6/1974 | Bomford et al. |
| 4,041,123 | A | | 8/1977 | Lange et al. |
| 4,259,112 | A | | 3/1981 | Dolowy, Jr. et al. |
| 4,463,058 | A | | 7/1984 | Hood et al. |
| 4,469,537 | A | | 9/1984 | Ashton et al. |
| 4,499,048 | A | | 2/1985 | Hanejko |
| 4,597,792 | A | | 7/1986 | Webster |
| 4,626,294 | A | | 12/1986 | Sanders, Jr. |
| 4,647,321 | A | | 3/1987 | Adam |
| 4,661,172 | A | | 4/1987 | Skinner et al. |
| 4,667,497 | A | | 5/1987 | Oslin et al. |
| 4,689,090 | A | | 8/1987 | Sawtell et al. |
| 4,710,246 | A | | 12/1987 | LeCaer et al. |
| 4,713,216 | A | | 12/1987 | Higashi et al. |
| 4,755,221 | A | | 7/1988 | Paliwal et al. |
| 4,853,178 | A | | 8/1989 | Oslin |
| 4,865,806 | A | | 9/1989 | Skibo et al. |
| 4,874,440 | A | | 10/1989 | Sawtell et al. |
| 4,915,605 | A | | 4/1990 | Chan et al. |
| 4,927,470 | A | | 5/1990 | Cho |
| 4,933,140 | A | | 6/1990 | Oslin |
| 4,946,517 | A | | 8/1990 | Cho |
| 4,964,927 | A | | 10/1990 | Shiflet et al. |
| 4,988,464 | A | | 1/1991 | Riley |
| 5,032,352 | A | | 7/1991 | Meeks et al. |
| 5,053,084 | A | | 10/1991 | Masumoto et al. |
| 5,055,257 | A | | 10/1991 | Chakrabarti et al. |
| 5,059,390 | A | | 10/1991 | Burleigh et al. |
| 5,066,342 | A | | 11/1991 | Rioja et al. |
| 5,074,935 | A | * | 12/1991 | Masumoto et al. ..... 148/403 |
| 5,076,340 | A | | 12/1991 | Bruski et al. |
| 5,076,865 | A | | 12/1991 | Hashimoto et al. |
| 5,130,209 | A | | 7/1992 | Das et al. |
| 5,133,931 | A | | 7/1992 | Cho |
| 5,198,045 | A | | 3/1993 | Cho et al. |
| 5,211,910 | A | | 5/1993 | Pickens et al. |
| 5,226,983 | A | | 7/1993 | Skinner et al. |
| 5,256,215 | A | | 10/1993 | Horimura |
| 5,308,410 | A | | 5/1994 | Horimura et al. |
| 5,312,494 | A | | 5/1994 | Horimura et al. |
| 5,318,641 | A | | 6/1994 | Masumoto et al. |
| 5,397,403 | A | | 3/1995 | Horimura et al. |
| 5,458,700 | A | | 10/1995 | Masumoto et al. |
| 5,462,712 | A | | 10/1995 | Langan et al. |
| 5,480,470 | A | | 1/1996 | Miller et al. |
| 5,597,529 | A | | 1/1997 | Tack |
| 5,620,652 | A | | 4/1997 | Tack et al. |
| 5,624,632 | A | | 4/1997 | Baumann et al. |
| 5,882,449 | A | | 3/1999 | Waldron et al. |
| 6,139,653 | A | | 10/2000 | Fernandes et al. |
| 6,149,737 | A | | 11/2000 | Hattori et al. |
| 6,248,453 | B1 | | 6/2001 | Watson |
| 6,254,704 | B1 | | 7/2001 | Laul et al. |
| 6,258,318 | B1 | | 7/2001 | Lenczowski et al. |
| 6,309,594 | B1 | | 10/2001 | Meeks, III et al. |
| 6,312,643 | B1 | | 11/2001 | Upadhya et al. |
| 6,315,948 | B1 | | 11/2001 | Lenczowski et al. |
| 6,331,218 | B1 | | 12/2001 | Inoue et al. |
| 6,355,209 | B1 | | 3/2002 | Dilmore et al. |

(Continued)

FOREIGN PATENT DOCUMENTS

CN 1436870 A 8/2003

(Continued)

OTHER PUBLICATIONS

Cook, R., et al. "Aluminum and Aluminum Alloy Powders for P/M Applications." The Aluminum Powder Company Limited, Ceracon Inc.

(Continued)

*Primary Examiner*—George Wyszomierski
(74) *Attorney, Agent, or Firm*—Kinney & Lange, P.A.

(57) ABSTRACT

An improved amorphous aluminum alloy having high strength, ductility, corrosion resistance and fracture toughness is disclosed. The alloy has an amorphous phase and a coherent $L1_2$ phase. The alloy has nickel, cerium, at least one of scandium, erbium, thulium, ytterbium, and lutetium; and at least one of gadolinium, yttrium, zirconium, titanium, hafnium, niobium and iron. The volume fraction of the amorphous phase ranges from about 50 percent to about 95 percent and the volume fraction of the coherent $L1_2$ phase ranges from about 5 percent to about 50 percent.

8 Claims, 7 Drawing Sheets

U.S. PATENT DOCUMENTS

| | | | |
|---|---|---|---|
| 6,368,427 | B1 | 4/2002 | Sigworth |
| 6,506,503 | B1 | 1/2003 | Mergen et al. |
| 6,517,954 | B1 | 2/2003 | Mergen et al. |
| 6,524,410 | B1 | 2/2003 | Kramer et al. |
| 6,531,004 | B1 | 3/2003 | Lenczowski et al. |
| 6,562,154 | B1 | 5/2003 | Rioja et al. |
| 6,630,008 | B1 | 10/2003 | Meeks, III et al. |
| 6,702,982 | B1 | 3/2004 | Chin et al. |
| 6,902,699 | B2 | 6/2005 | Fritzemeier et al. |
| 6,918,970 | B2 | 7/2005 | Lee et al. |
| 6,974,510 | B2 | 12/2005 | Watson |
| 7,048,815 | B2 | 5/2006 | Senkov et al. |
| 7,097,807 | B1 | 8/2006 | Meeks, III et al. |
| 7,241,328 | B2 | 7/2007 | Keener |
| 7,344,675 | B2 | 3/2008 | Van Daam et al. |
| 2001/0054247 | A1 | 12/2001 | Stall et al. |
| 2003/0192627 | A1 | 10/2003 | Lee et al. |
| 2004/0046402 | A1 | 3/2004 | Winardi |
| 2004/0055671 | A1 | 3/2004 | Olson et al. |
| 2004/0089382 | A1 | 5/2004 | Senkov et al. |
| 2004/0170522 | A1 | 9/2004 | Watson |
| 2004/0191111 | A1 | 9/2004 | Nie et al. |
| 2005/0147520 | A1 | 7/2005 | Canzona |
| 2006/0011272 | A1 | 1/2006 | Lin et al. |
| 2006/0093512 | A1 | 5/2006 | Pandey |
| 2006/0172073 | A1 | 8/2006 | Groza et al. |
| 2006/0269437 | A1 | 11/2006 | Pandey |
| 2007/0048167 | A1 | 3/2007 | Yano |
| 2007/0062669 | A1 | 3/2007 | Song et al. |
| 2008/0066833 | A1 | 3/2008 | Lin et al. |

FOREIGN PATENT DOCUMENTS

| | | | |
|---|---|---|---|
| CN | 101205578 | A | 6/2008 |
| EP | 0 208 631 | A1 | 6/1986 |
| EP | 0584596 | | 3/1994 |
| EP | 1 111 079 | A1 | 6/2001 |
| EP | 1 249 303 | A1 | 10/2002 |
| EP | 1 170 394 | B1 | 4/2004 |
| EP | 1 471 157 | A1 | 10/2004 |
| EP | 1 111 078 | B1 | 9/2006 |
| EP | 1 728 881 | A2 | 12/2006 |
| EP | 1 788 102 | A1 | 5/2007 |
| FR | 2656629 | | 7/1991 |
| FR | 2843754 | A1 | 2/2004 |
| JP | 2004218638 | | 8/1992 |
| JP | 9104940 | A | 4/1997 |
| JP | 9279284 | A | 10/1997 |
| JP | 11156584 | A | 6/1999 |
| JP | 2000119786 | A | 4/2000 |
| JP | 2001038442 | A | 2/2001 |
| JP | 2007188878 | | 7/2007 |
| RU | 2001144 | C1 | 10/1993 |
| RU | 2001145 | C1 | 10/1993 |
| WO | 90 02620 | A1 | 3/1990 |
| WO | 91 10755 | A2 | 7/1991 |
| WO | 9111550 | A1 | 8/1991 |
| WO | 9532074 | A2 | 11/1995 |
| WO | 96 10099 | A1 | 4/1996 |
| WO | 9833947 | A1 | 8/1998 |
| WO | 00 37696 | A1 | 6/2000 |
| WO | 02 29139 | A2 | 4/2002 |
| WO | 03 052154 | A1 | 6/2003 |
| WO | 03085145 | A2 | 10/2003 |
| WO | 03085146 | A1 | 10/2003 |
| WO | 03 104505 | A2 | 12/2003 |
| WO | 2004 005562 | A2 | 1/2004 |
| WO | 2004046402 | A2 | 6/2004 |
| WO | 2005 045080 | A1 | 5/2005 |
| WO | 2005047554 | A1 | 5/2005 |

OTHER PUBLICATIONS

"Aluminum and Aluminum Alloys." ASM Specialty Handbook. 1993. ASM International. p. 559.

ASM Handbook, vol. 7 ASM International, Materials Park, OH (1993) p. 396.

Gangopadhyay, A.K., et al. "Effect of rare-earth atomic radius on the devitrification of Al88RE8Ni4 amorphous alloys." Philosophical Magazine A, 2000, vol. 80, No. 5, pp. 1193-1206.

Riddle, Y.W., et al. "Improving Recrystallization Resistance in WRought Aluminum Alloys with Scandium Addition." Lightweight Alloys for Aerospace Applications VI (pp. 26-39), 2001 TMS Annual Meeting, New Orleans, Louisiana, Feb. 11-15, 2001.

Baikowski Malakoff Inc. "The many uses of High Purity Alumina." Technical Specs. http://www.baikowskimalakoff.com/pdf/Rc-Ls.pdf (2005).

Lotsko, D.V., et al. "Effect of small additions of transition metals on the structure of Al-Zn-Mg-Zr-Sc alloys." New Level of Properties. Advances in Insect Physiology. Academic Press, vol. 2, Nov. 4, 2002. pp. 535-536.

Neikov, O.D., et al. "Properties of rapidly solidified powder aluminum alloys for elevated temperatures produced by water atomization." Advances in Powder Metallurgy & Particulate Materials. 2002. pp. 7-14-7-27.

Harada, Y. et al. "Microstructure of Al3Sc with ternary transition-metal additions." Materials Science and Engineering A329-331 (2002) 686-695.

Unal, A. et al. "Gas Atomization" from the section "Production of Aluminum and Aluminum-Alloy Powder" ASM Handbook, vol. 7. 2002.

Riddle, Y.W., et al. "A Study of Coarsening, Recrystallization, and Morphology of Microstructure in Al-Sc-(Zr)-(Mg) Alloys." Metallurgical and Materials Transactions A. vol. 35A, Jan. 2004. pp. 341-350.

Mil'Man, Y.V. et al. "Effect of Additional Alloying with Transition Metals on the STructure of an Al-7.1 Zn-1.3 Mg-0.12 Zr Alloy." Metallofizika I Noveishie Teknohologii, 26 (10), 1363-1378, 2004.

Tian, N. et al. "Heating rate dependence of glass transition and primary crystallization of Al88Gd6Er2Ni4 metallic glass." Scripta Materialia 53 (2005) pp. 681-685.

Litynska, L. et al. "Experimental and theoretical characterization of Al3Sc precipitates in Al-Mg-Si-Cu-Sc-Zr alloys." Zeitschrift Fur Metallkunde. vol. 97, No. 3. Jan. 1, 2006. pp. 321-324.

Pandey A B et al, "High Strength Discontinuously Reinforced Aluminum For Rocket Applications," Affordable Metal Matrix Composites For High Performance Applications. Symposia Proceedings, TMS (The Minerals, Metals & Materials Society), US, No. 2nd, Jan. 1, 2008, pp. 3-12.

Niu, Ben et al. "Influence of addition of 1-15 erbium on microstructure and crystallization behavior of Al-Ni-Y amorphous alloy" Zhongguo Xitu Xuebao, 26(4), pp. 450-454. 2008.

Riddle, Y.W., et al. "Recrystallization Performance of AA7050 Varied with Sc and Zr." Materials Science Forum. 2000. pp. 799-804.

Lotsko, D.V., et al. "High-strength aluminum-based alloys hardened by quasicrystalline nanoparticles." Science for Materials in the Frontier of Centuries: Advantages and Challenges, International Conference: Kyiv, Ukraine. Nov. 4-8, 2002. vol. 2. pp. 371-372.

Hardness Conversion Table. Downloaded from http://www.gordonengland.co.uk/hardness/hardness_conversion_2m.htm.

Rachek, O. P.: "X-ray diffraction study of amorphous alloys A1-Ni-Ce-Sc with using Ehrenfest's formula" Journal of Non-Crystalline Solids, 352(36-37), 3781-3786 Coden: JNCSBJ; ISSN: 0022-3093, 2006, XP002538088.

European Search Report—EP 09 25 1025—Dated Aug. 6, 2009—18 pages.

* cited by examiner

$L1_2$ STRENGTHENED AMORPHOUS ALUMINUM ALLOYS

CROSS-REFERENCE TO RELATED APPLICATIONS

This application is related to the following co-pending applications that are filed on even date herewith and are assigned to the same assignee: $L1_2$ ALUMINUM ALLOYS WITH BIMODAL AND TRIMODAL DISTRIBUTION, Ser. No. 12/148,395, DISPERSION STRENGTHENED $L1_2$ ALUMINUM ALLOYS, Ser. No. 12/148,432, HEAT TREATABLE $L1_2$ ALUMINUM ALLOYS, Ser. No. 12/148,383, HIGH STRENGTH $L1_2$ ALUMINUM ALLOYS, Ser. No. 12/148,394, HIGH STRENGTH $L1_2$ ALUMINUM ALLOYS, Ser. No. 12/148,382, HEAT TREATABLE $L1_2$ ALUMINUM ALLOYS, Ser. No. 12/148,396, HIGH STRENGTH $L1_2$ ALUMINUM ALLOYS, Ser. No. 12/148,387, HIGH STRENGTH ALUMINUM ALLOYS WITH $L1_2$ PRECIPITATES, Ser. No. 12/148,426, and HIGH STRENGTH $L1_2$ ALUMINUM ALLOYS, Ser. No. 12/148,459.

BACKGROUND

The present invention relates generally to aluminum alloys and more specifically to $L1_2$ phase dispersion strengthened aluminum alloys having ceramic reinforcement particles.

The combination of high strength, ductility, and fracture toughness, as well as low density, make aluminum alloys natural candidates for aerospace and space applications. However, their use is typically limited to temperatures below about 300° F. (149° C.) since most aluminum alloys start to lose strength in that temperature range as a result of coarsening of strengthening precipitates.

The development of aluminum alloys with improved elevated temperature mechanical properties is a continuing process. Some attempts have included aluminum-iron and aluminum-chromium based alloys such as Al—Fe—Ce, Al—Fe—V—Si, Al—Fe—Ce—W, and Al—Cr—Zr—Mn that contain incoherent dispersoids. These alloys, however, also lose strength at elevated temperatures due to particle coarsening. In addition, these alloys exhibit ductility and fracture toughness values lower than other commercially available aluminum alloys.

Other attempts have included the development of mechanically alloyed Al—Mg and Al—Ti alloys containing ceramic dispersoids. These alloys exhibit improved high temperature strength due to the particle dispersion, but the ductility and fracture toughness are not improved.

U.S. Pat. No. 6,248,453 discloses aluminum alloys strengthened by dispersed $Al_3X$ $L1_2$ intermetallic phases where X is selected from the group consisting of Sc, Er, Lu, Yb, Tm, and U. The $Al_3X$ particles are coherent with the aluminum alloy matrix and are resistant to coarsening at elevated temperatures. The improved mechanical properties of the disclosed dispersion strengthened $L1_{F2}$ aluminum alloys are stable up to 572° F. (300° C.). U.S. Patent Application Publication No. 2006/0269437 A1 discloses an aluminum alloy that contains scandium and other elements.

Amorphous alloys have received interest in recent years because materials with an amorphous structure are usually very strong and corrosion resistant in comparison with crystalline structures having the same composition. However, amorphous aluminum alloys have been found to have lower ductility and fracture toughness than the crystalline form. Aluminum based amorphous alloys with high strength and low density are desirable because of their lower density and their applicability in the aerospace and space industries. Amorphous aluminum alloys would also be useful in armor applications where lightweight materials are desired.

SUMMARY

The present invention is an improved amorphous aluminum alloy having a crystalline $L1_2$ aluminum alloy phase dispersed in an amorphous aluminum alloy matrix. The $L1_2$ phase results in improved ductility and fracture toughness while maintaining the strength and corrosion resistance of the amorphous phase. The desired volume fraction of the amorphous phase is from about 50 percent to about 95 percent, more preferably about 60 percent to about 90 percent, and even more preferably about 70 percent to about 80 percent.

The aluminum alloy of this invention is formed into the amorphous phase and a fine, coherent $L1_2$ phase by use of the rapid solidification process.

DETAILED DESCRIPTION

The alloys of this invention comprises an amorphous matrix of aluminum, nickel and cerium strengthened by having dispersed therein a fine, coherent $L1_2$ phase based on $Al_3X$ where X is least one first element selected from scandium, erbium, thulium, ytterbium, lutetium, and at least one second element selected from iron, gadolinium, yttrium, zirconium, titanium, hafnium, and niobium.

Figure 1:
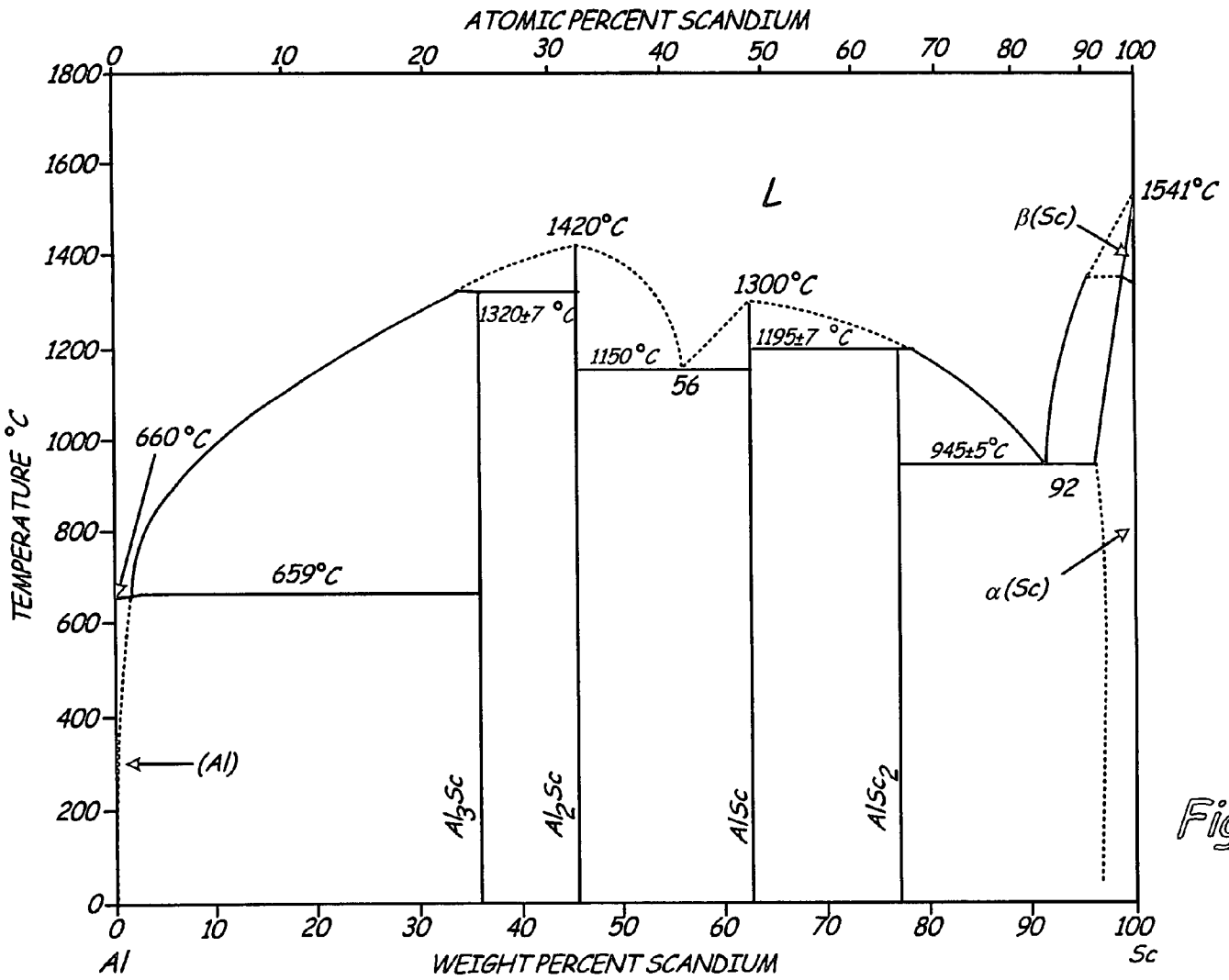
FIG. 1 is an aluminum nickel phase diagram.

The aluminum nickel phase diagram is shown in FIG. 1. The aluminum nickel binary system is a simple eutectic at 5.7 weight percent nickel and 1183.8° F. (639.9° C.). There is little solubility of nickel in aluminum. However, the solubility can be extended significantly by utilizing rapid solidification processes. The equilibrium phase in the aluminum nickel eutectic system is intermetallic $Al_3Ni$.

Figure 2:
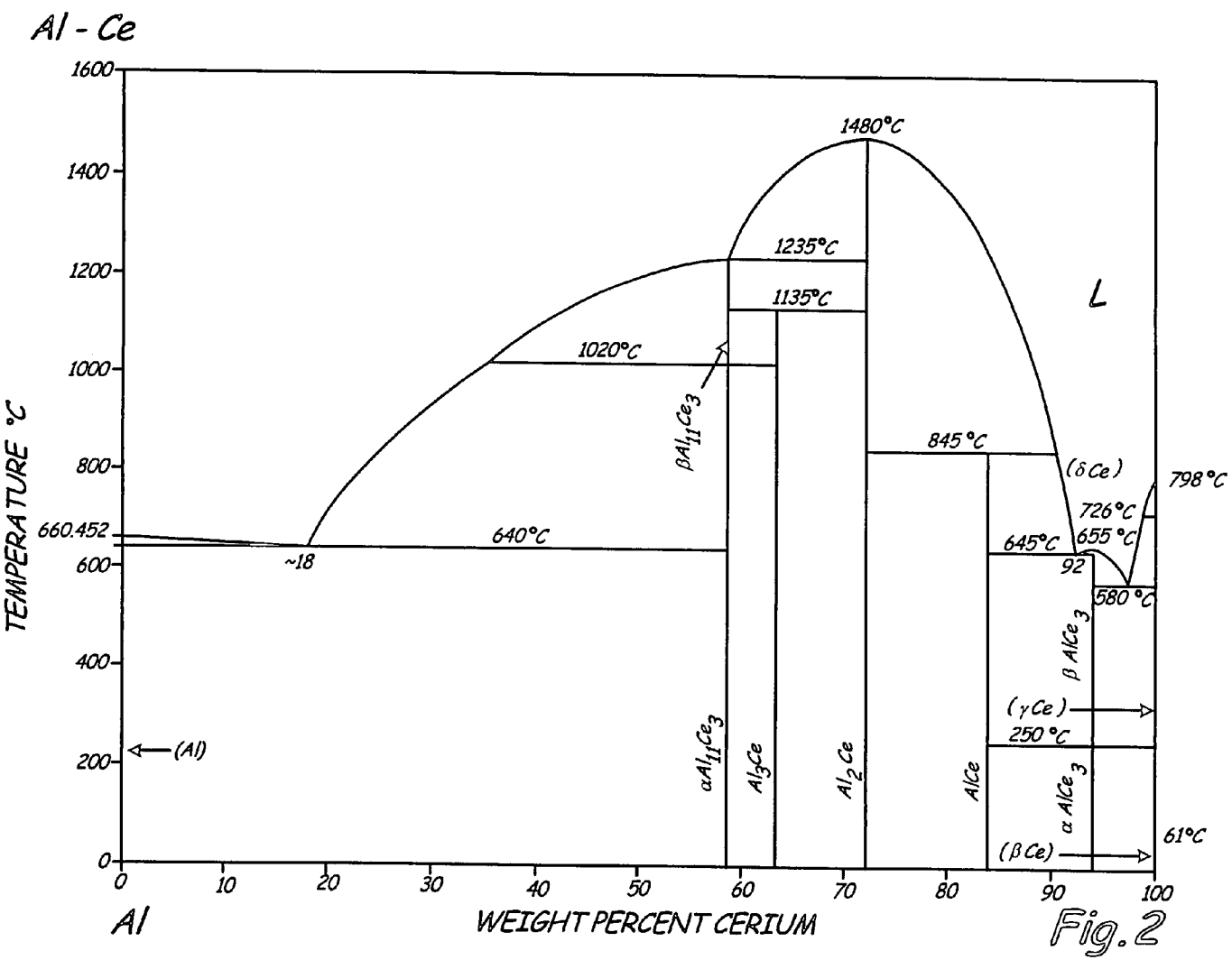
FIG. 2 is an aluminum cerium phase diagram.

The aluminum cerium phase diagram is shown in FIG. 2. The aluminum cerium binary system is a simple eutectic at 18 weight percent cerium and 1184° F. (640° C.). There is little or no solubility of cerium in aluminum. However the solubility can be extended significantly by utilizing rapid solidification processes. Metastable $Al_3Ce$ can form in rapidly cooled hypereutectic aluminum cerium alloys. The equilibrium phase in eutectic alloys is $Al_{11}Ce_3$ Cerium helps in forming an amorphous structure in aluminum in the presence of nickel due to deep eutectics.

Scandium forms $Al_3Sc$ dispersoids that are fine and coherent with the aluminum matrix. Lattice parameters of aluminum and $Al_3Sc$ are very close (0.405 nm and 0.410 nm respectively), indicating that there is minimal or no driving force for causing growth of the $Al_3Sc$ dispersoids. This low interfacial energy makes the $Al_3Sc$ dispersoids thermally stable and resistant to coarsening up to temperatures as high as about 842° F. (450° C.). In the alloys of this invention these $Al_3Sc$ dispersoids are made stronger and more resistant to coarsening at elevated temperatures by adding suitable alloying elements such as gadolinium, yttrium, zirconium, titanium, hafnium, niobium, iron or combinations thereof, that enter $Al_3Sc$ in solution.

Erbium forms $Al_3Er$ dispersoids in the aluminum matrix that are fine and coherent with the aluminum matrix. The lattice parameters of aluminum and $Al_3Er$ are close (0.405 nm and 0.417 nm respectively), indicating there is minimal driving force for causing growth of the $Al_3Er$ dispersoids. This low interfacial energy makes the $Al_3Er$ dispersoids thermally stable and resistant to coarsening up to temperatures as high as about 842° F. (450° C.). In the alloys of this invention, these $Al_3Er$ dispersoids are made stronger and more resistant to coarsening at elevated temperatures by adding suitable alloying elements such as gadolinium, yttrium, zirconium, titanium, hafnium, niobium, iron or combinations thereof that enter $Al_3Er$ in solution.

Thulium forms metastable $Al_3Tm$ dispersoids in the aluminum matrix that are fine and coherent with the aluminum matrix. The lattice parameters of aluminum and $Al_3Tm$ are close (0.405 nm and 0.420 nm respectively), indicating there is minimal driving force for causing growth of the $Al_3Tm$ dispersoids. This low interfacial energy makes the $Al_3Tm$ dispersoids thermally stable and resistant to coarsening up to temperatures as high as about 842° F. (450° C.). In the alloys of this invention these $Al_3Tm$ dispersoids are made stronger and more resistant to coarsening at elevated temperatures by adding suitable alloying elements such as gadolinium, yttrium, zirconium, titanium, hafnium, niobium, iron or combinations thereof that enter $Al_3Tm$ in solution.

Ytterbium forms $Al_3Yb$ dispersoids in the aluminum matrix that are fine and coherent with the aluminum matrix. The lattice parameters of Al and $Al_3Yb$ are close (0.405 nm and 0.420 nm respectively), indicating there is minimal driving force for causing growth of the $Al_3Yb$ dispersoids. This low interfacial energy makes the $Al_3Yb$ dispersoids thermally stable and resistant to coarsening up to temperatures as high as about 842° F. (450° C.). In the alloys of this invention, these $Al_3Yb$ dispersoids are made stronger and more resistant to coarsening at elevated temperatures by adding suitable alloying elements such as gadolinium, yttrium, zirconium, titanium, hafnium, niobium, iron or combinations thereof that enter $Al_3Yb$ in solution.

Lutetium forms $Al_3Lu$ dispersoids in the aluminum matrix that are fine and coherent with the aluminum matrix. The lattice parameters of Al and $Al_3Lu$ are close (0.405 nm and 0.419 nm respectively), indicating there is minimal driving force for causing growth of the $Al_3Lu$ dispersoids. This low interfacial energy makes the $Al_3Lu$ dispersoids thermally stable and resistant to coarsening up to temperatures as high as about 842° F. (450° C.). In the alloys of this invention, these $Al_3Lu$ dispersoids are made stronger and more resistant to coarsening at elevated temperatures by adding suitable alloying elements such as gadolinium, yttrium, zirconium, titanium, hafnium, niobium, iron or mixtures thereof that enter $Al_3Lu$ in solution.

Gadolinium forms metastable $Al_3Gd$ dispersoids in the aluminum matrix that are stable up to temperatures as high as about 842° F. (450° C.) due to their low diffusivity in aluminum. The $Al_3Gd$ dispersoids have an $L1_2$ structure in the metastable condition and a $D0_{19}$ structure in the equilibrium condition. Despite its large atomic size, gadolinium has fairly high solubility in the $Al_3X$ intermetallic dispersoids (where X is scandium, erbium, thulium, ytterbium or lutetium). Gadolinium can substitute for the X atoms in $Al_3X$ intermetallic, thereby forming an ordered $L1_2$ phase which results in improved thermal and structural stability.

Yttrium forms metastable $Al_3Y$ dispersoids in the aluminum matrix that have an $L1_2$ structure in the metastable condition and a $D0_{19}$ structure in the equilibrium condition. The metastable $Al_3Y$ dispersoids have a low diffusion coefficient which makes them thermally stable and highly resistant to coarsening. Yttrium has a high solubility in the $Al_3X$ intermetallic dispersoids allowing large amounts of yttrium to substitute for X in the $Al_3X$ $L1_2$ dispersoids which results in improved thermal and structural stability.

Zirconium forms $Al_3Zr$ dispersoids in the aluminum matrix that have an $L1_2$ structure in the metastable condition and $D0_{23}$ structure in the equilibrium condition. The metastable $Al_3Zr$ dispersoids have a low diffusion coefficient which makes them thermally stable and highly resistant to coarsening. Zirconium has a high solubility in the $Al_3X$ dispersoids allowing large amounts of zirconium to substitute for X in the $Al_3X$ dispersoids, which results in improved thermal and structural stability.

Titanium forms $Al_3Ti$ dispersoids in the aluminum matrix that have an $L1_2$ structure in the metastable condition and $D0_{22}$ structure in the equilibrium condition. The metastable $Al_3Ti$ despersoids have a low diffusion coefficient which makes them thermally stable and highly resistant to coarsening. Titanium has a high solubility in the $Al_3X$ dispersoids allowing large amounts of titanium to substitute for X in the $Al_3X$ dispersoids, which result in improved thermal and structural stability.

Hafnium forms metastable $Al_3Hf$ dispersoids in the aluminum matrix that have an $L1_2$ structure in the metastable condition and a $D0_{23}$ structure in the equilibrium condition. The $Al_3Hf$ dispersoids have a low diffusion coefficient, which makes them thermally stable and highly resistant to coarsening. Hafnium has a high solubility in the $Al_3X$ dispersoids allowing large amounts of hafnium to substitute for scandium, erbium, thulium, ytterbium, and lutetium in the above mentioned $Al_3X$ dispersoides, which results in stronger and more thermally stable dispersoids.

Niobium forms metastable $Al_3Nb$ dispersoids in the aluminum matrix that have an $L1_2$ structure in the metastable condition and a $D0_{22}$ structure in the equilibrium condition. Niobium has a lower solubility in the $Al_3X$ dispersoids than hafnium or yttrium, allowing relatively lower amounts of niobium than hafnium or yttrium to substitute for X in the $Al_3X$ dispersoids. Nonetheless, niobium can be very effective in slowing down the coarsening kinetics of the $Al_3X$ dispersoids because the $Al_3Nb$ dispersoids are thermally stable. The substitution of niobium for X in the above mentioned $Al_3X$ dispersoids results in stronger and more thermally stable dispersoids.

Iron forms $Al_6Fe$ dispersoids in the aluminum matrix in the metastable condition, and forms $Al_3Fe$ dispersoids in the equilibrium condition. Iron has a little solubility in aluminum matrix in the equilibrium condition which can be extended significantly by a rapid solidification process. Iron can be very effective in slowing down the coarsening kinetics because the $Al_6Fe$ dispersoids are thermally stable due to its very low diffusion coefficient in aluminum. Iron provides solid solution and dispersion strengthening in aluminum.

The amount of nickel present in the matrix of this invention may vary from about 4 to about 25 weight percent, more preferably from about 6 to about 20 weight percent, and even more preferably from about 8 to about 15 weight percent.

The amount of cerium present in the matrix of this invention may vary from about 2 to about 25 weight percent, more preferably from about 4 to about 20 weight percent, and even more preferably from about 6 to about 15 weight percent.

Figure 3:
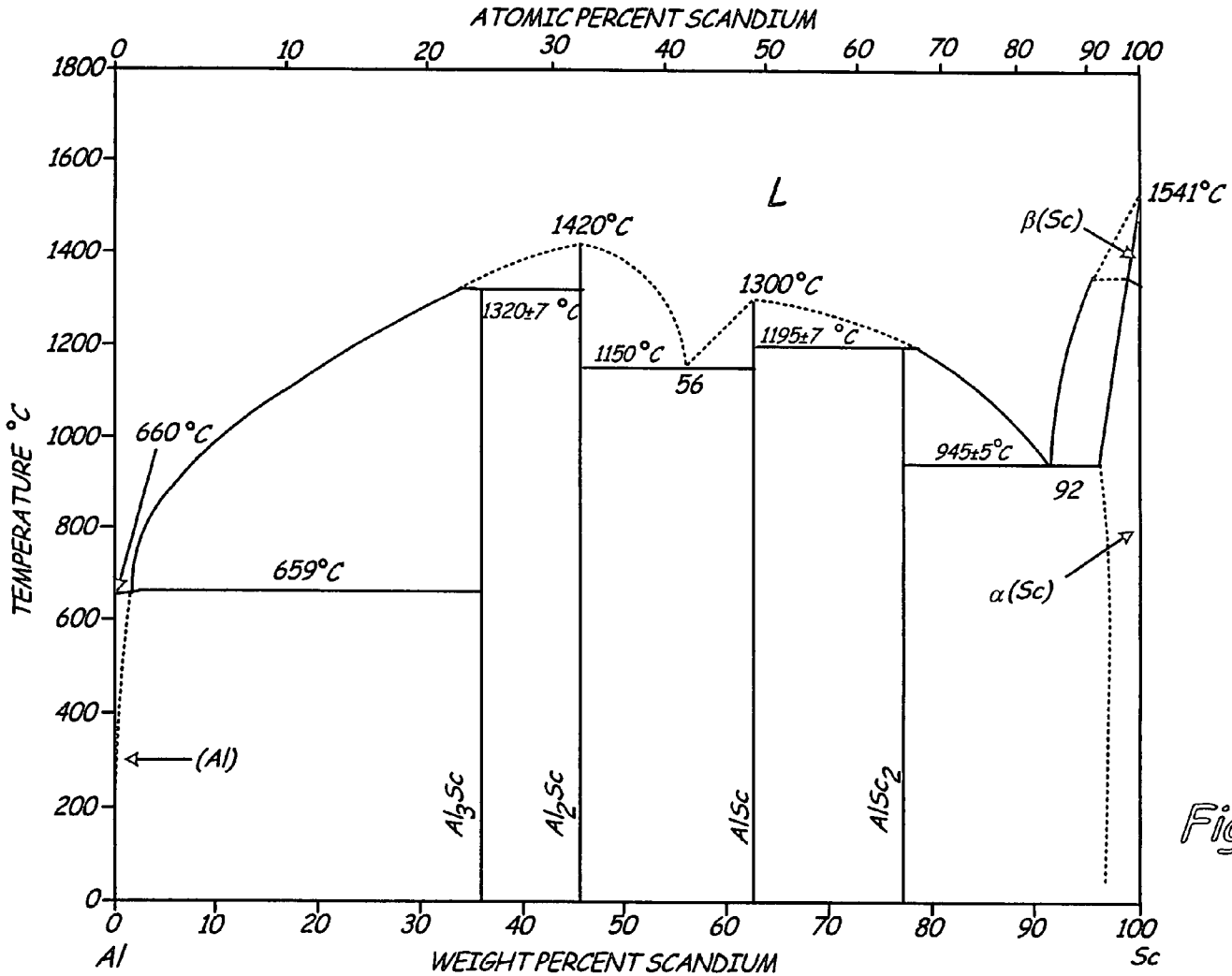
FIG. 3 is an aluminum scandium phase diagram.

The amount of scandium present in the alloys of this invention, if any, may vary from about 0.1 to about 4 weight percent, more preferably from about 0.1 to about 3 weight percent, and even more preferably from about 0.2 to about 2.5 weight percent. The Al—Sc phase diagram shown in FIG. 3 indicates a eutectic reaction at about 0.5 weight percent scandium at about 1219° F. (659° C.) resulting in a solid solution of scandium and aluminum and $Al_3Sc$ dispersoids. Aluminum alloys with less than 0.5 weight percent scandium can be quenched from the melt to retain scandium in solid solution that may precipitate as dispersed $L1_2$ intermetallic $Al_3Sc$ following an aging treatment. Alloys with scandium in excess of the eutectic composition (hypereutectic alloys) can only retain scandium in solid solution by rapid solidification processing (RSP) where cooling rates are in excess of about $10^{3}$° C./second. Alloys with scandium in excess of the eutectic composition cooled normally will have a microstructure consisting of relatively large $Al_3Sc$ dispersoids in a finally divided aluminum-$Al_3Sc$ eutectic phase matrix.

Figure 4:
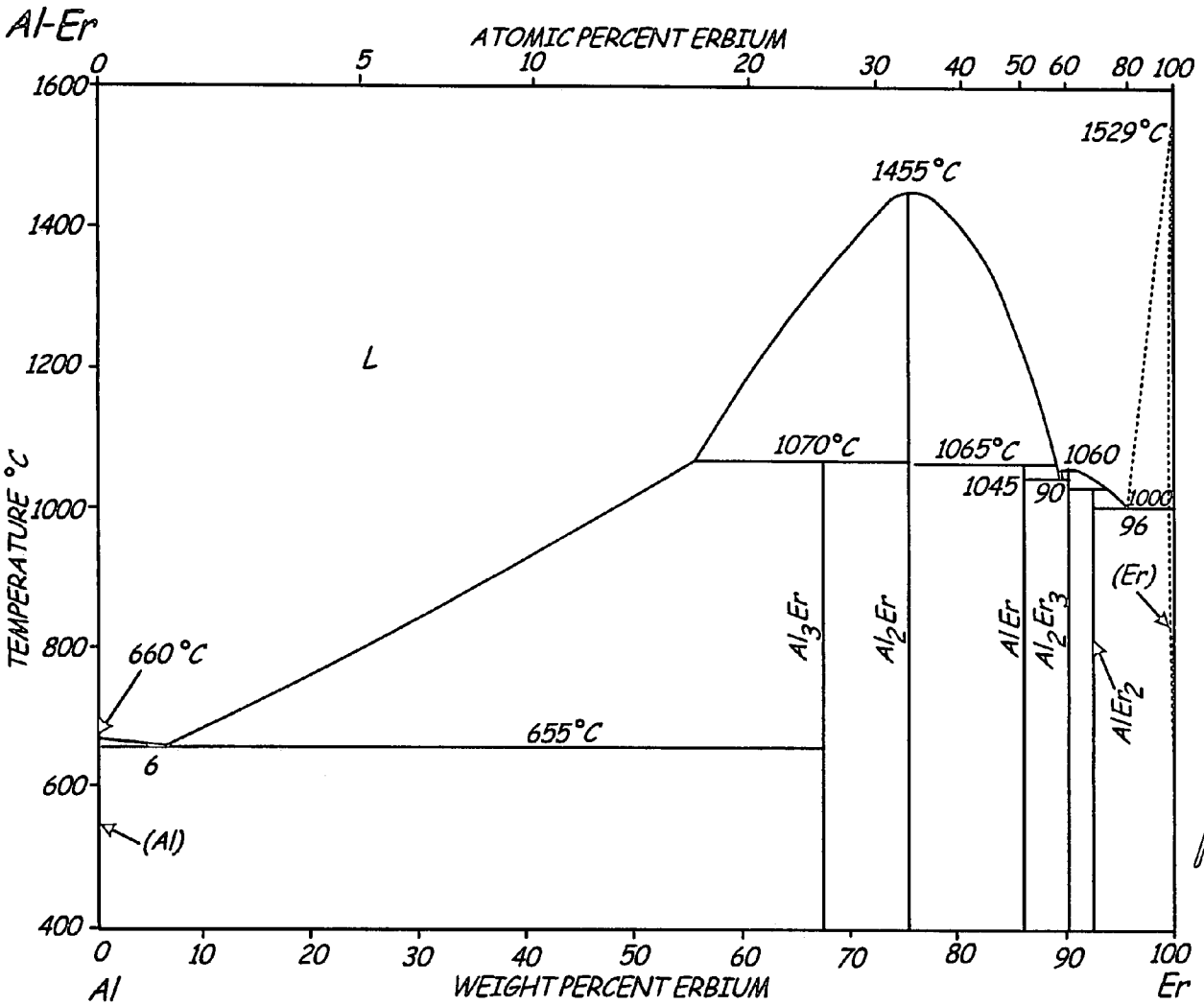
FIG. 4 is an aluminum erbium phase diagram.

The amount of erbium present in the alloys of this invention, if any, may vary from about 0.1 to about 20 weight percent, more preferably from about 0.3 to about 15 weight percent, and even more preferably from about 0.5 to about 10 weight percent. The Al—Er phase diagram shown in FIG. 4 indicates a eutectic reaction at about 6 weight percent erbium at about 1211° F. (655° C.). Aluminum alloys with less than about 6 weight percent erbium can be quenched from the melt to retain erbium in solid solutions that may precipitate as dispersed $L1_2$ intermetallic $Al_3Er$ following an aging treatment. Alloys with erbium in excess of the eutectic composition can only retain erbium in solid solution by rapid solidification processing (RSP) where cooling rates are in excess of about $10^{3}$° C./second. Alloys with erbium in excess of the eutectic composition cooled normally will have a microstructure consisting of relatively large $Al_3Er$ dispersoids in a finely divided aluminum-$Al_3Er$ eutectic phase matrix.

Figure 5:
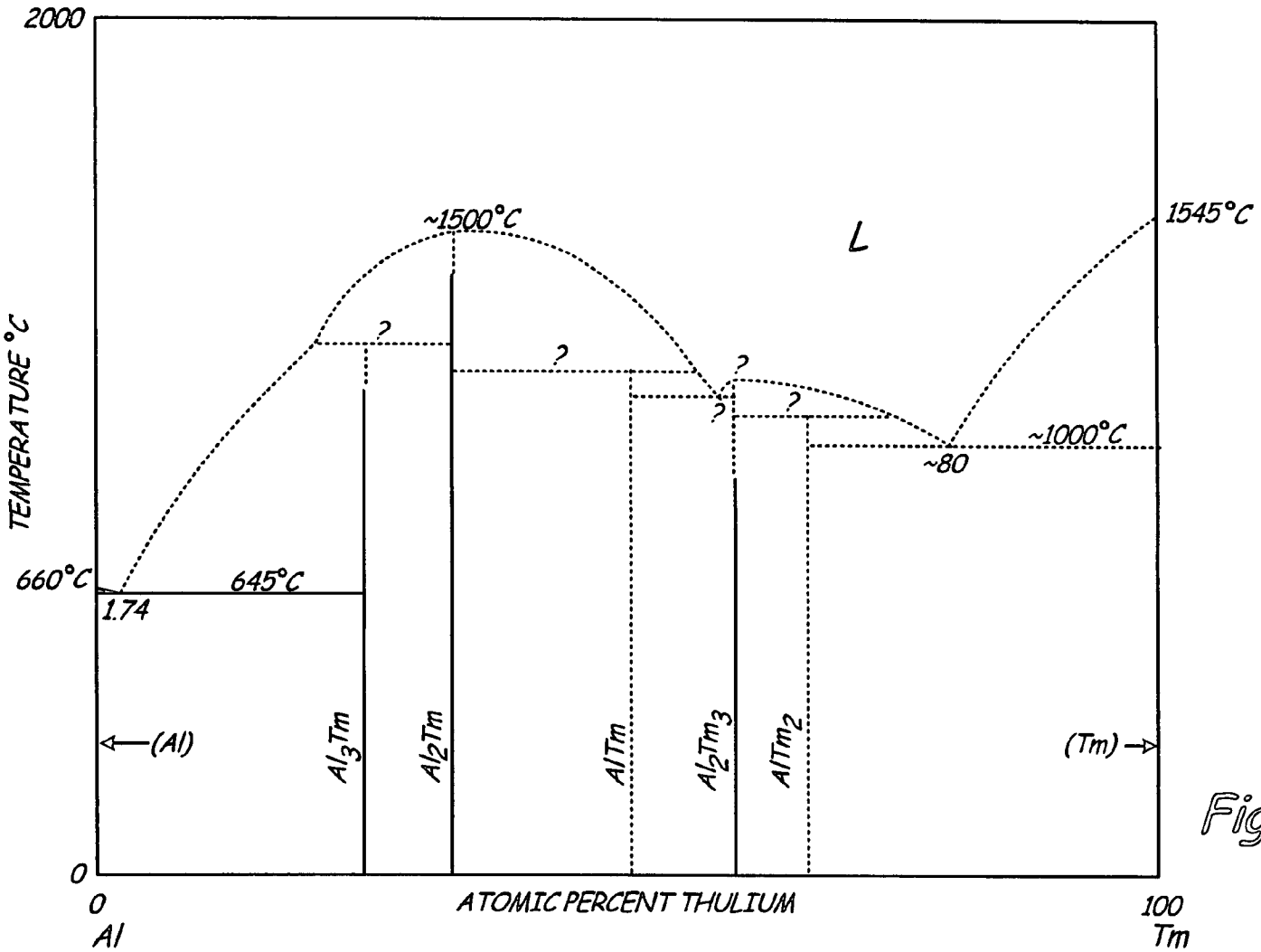
FIG. 5 is an aluminum thulium phase diagram.

The amount of thulium present in the alloys of this invention, if any, may vary from about 0.1 to about 15 weight percent, more preferably from about 0.2 to about 10 weight percent, and even more preferably from about 0.4 to about 6 weight percent. The Al—Tm phase diagram shown in FIG. 5 indicates a eutectic reaction at about 10 weight percent thulium at about 1193° F. (645° C.). Thulium forms metastable $Al_3Tm$ dispersoids in the aluminum matrix that have an $L1_2$ structure in the equilibrium condition. The $Al_3Tm$ dispersoids have a low diffusion coefficient which makes them thermally stable and highly resistant to coarsening. Aluminum alloys with less than 10 weight percent thulium can be quenched from the melt to retain thulium in solid solution that may precipitate as dispersed metastable $L1_2$ intermetallic $Al_3Tm$ following an aging treatment. Alloys with thulium in excess of the eutectic composition can only retain Tm in solid solution by rapid solidification processing (RSP) where cooling rates are in excess of about $10^{3}$° C./second.

Figure 6:
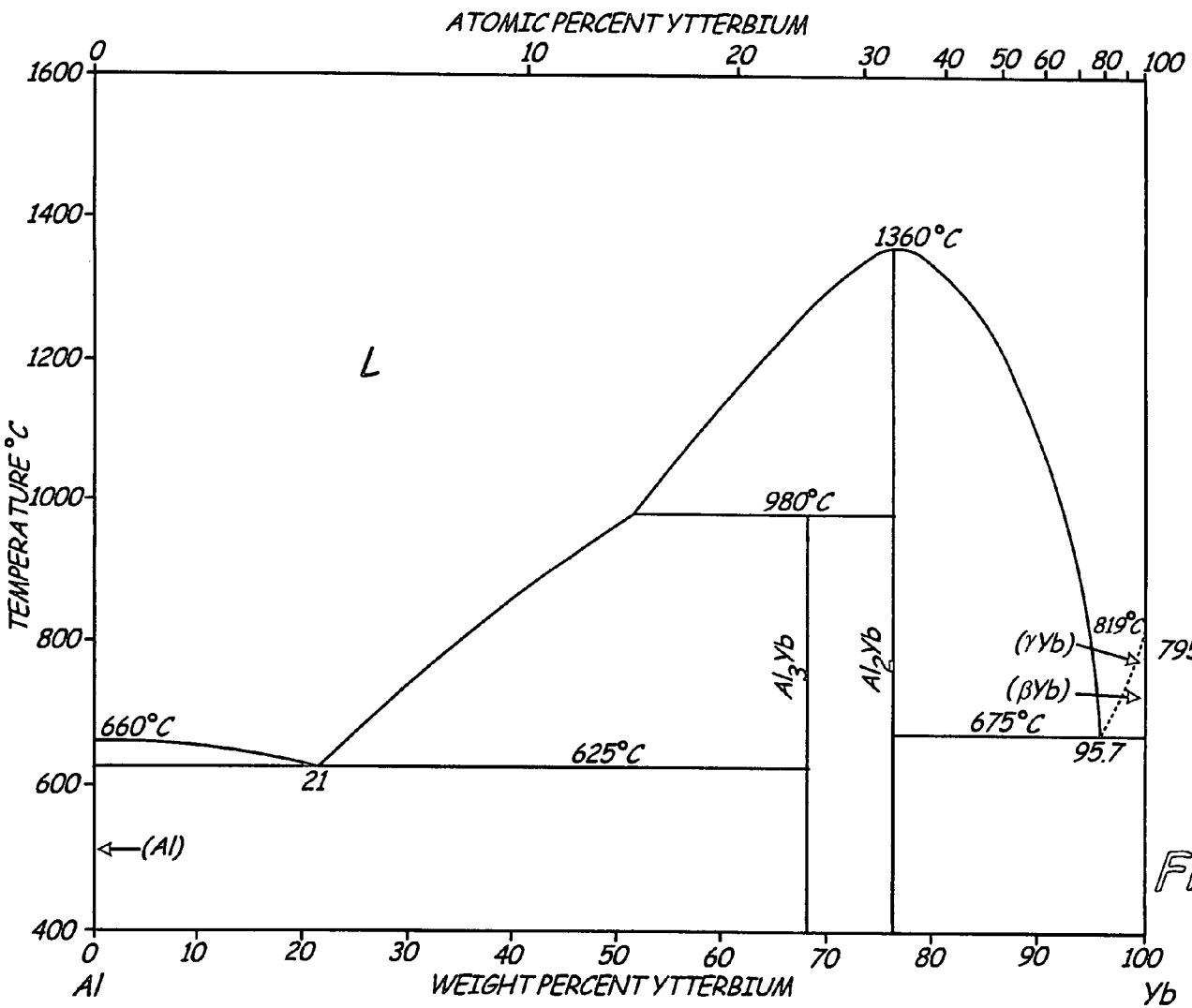
FIG. 6 is an aluminum ytterbium phase diagram.

The amount of ytterbium present in the alloys of this invention, if any, may vary from about 0.1 to about 25 weight percent, more preferably from about 0.3 to about 20 weight percent, and even more preferably from about 0.4 to about 10 weight percent. The Al—Yb phase diagram shown in FIG. 6 indicates a eutectic reaction at about 21 weight percent ytterbium at about 1157° F. (625° C.). Aluminum alloys with less than about 21 weight percent ytterbium can be quenched from the melt to retain ytterbium in solid solution that may precipitate as dispersed $L1_2$ intermetallic $Al_3Yb$ following an aging treatment. Alloys with ytterbium in excess of the eutectic composition can only retain ytterbium in solid solution by rapid solidification processing (RSP) where cooling rates are in excess of about $10^{3}$° C./second.

Figure 7:
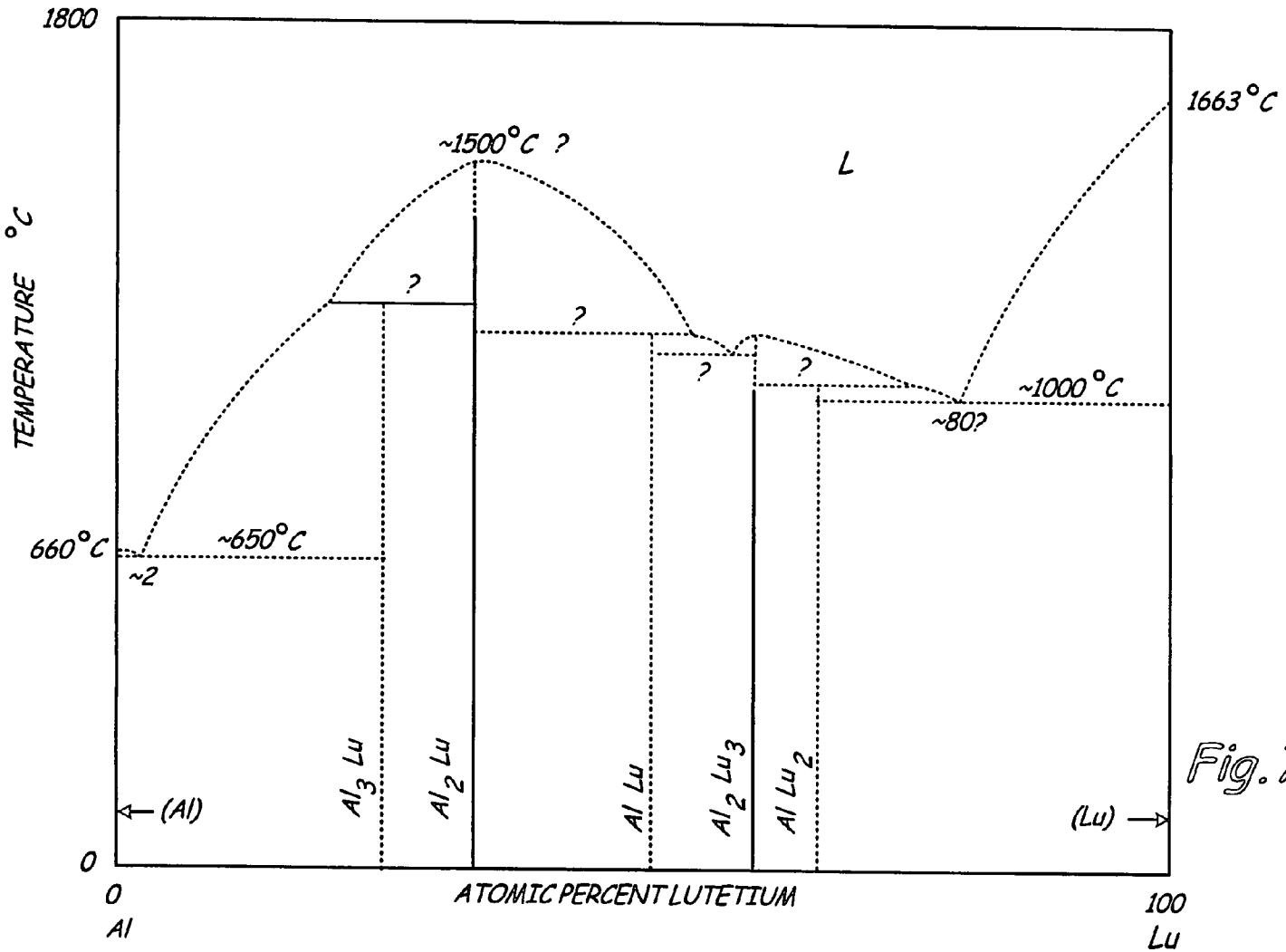
FIG. 7 is an aluminum lutetium phase diagram.

The amount of lutetium present in the alloys of this invention, if any, may vary from about 0.1 to about 25 weight percent, more preferably from about 0.3 to about 20 weight percent, and even more preferably from about 0.4 to about 10 weight percent. The Al—Lu phase diagram shown in FIG. 7 indicates a eutectic reaction at about 11.7 weight percent Lu at about 1202° F. (650° C.). Aluminum alloys with less than about 11.7 weight percent lutetium can be quenched from the melt to retain Lu in solid solution that may precipitate as dispersed $L1_2$ intermetallic $Al_3Lu$ following an aging treatment. Alloys with Lu in excess of the eutectic composition can only retain Lu in solid solution by rapid solidification processing (RSP) where cooling rates are in excess of about $10^{3}$° C./second.

The amount of gadolinium present in the alloys of this invention, if any, may vary from about 2 to about 30 weight percent, more preferably from about 4 to about 25 weight percent, and even more preferably from about 6 to about 20 weight percent.

The amount of yttrium present in the alloys of this invention, if any, may vary from about 2 to about 30 weight percent, more preferably from about 4 to about 25 weight percent, and even more preferably from about 6 to about 20 weight percent.

The amount of zirconium present in the alloys of this invention, if any, may vary from about 0.5 to about 5 weight percent, more preferably from about 1 to about 4 weight percent, and even more preferably from about 1 to about 3 weight percent.

The amount of titanium present in the alloys of this invention, if any, may vary from about 0.5 to about 10 weight percent, more preferably from about 1 to about 8 weight percent, and even more preferably from about 1 to about 4 weight percent.

The amount of hafnium present in the alloys of this invention, if any, may vary from about 0.5 to about 10 weight percent, more preferably from about 1 to about 8 weight percent, and even more preferably from about 1 to about 4 weight percent.

The amount of niobium present in the alloys of this invention, if any, may vary from about 0.5 to about 5 weight percent, more preferably from about 1 to about 4 weight percent, and even more preferably from about 1 to about 3 weight percent.

The amount of iron present in the matrix of this invention may vary from about 0.5 to about 15 weight percent, more preferably from about 1 to about 10 weight percent, and even more preferably from about 2 to about 8 weight percent.

Forming the amorphous structure of this invention enhances the strength of the alloys, whereas ductility, fracture toughness and thermal stability are increased by the dispersed, fine, coherent $L1_2$ particles in the microstructure.

Exemplary aluminum alloys of this invention include, but are not limited to (in weight percent):

about Al-(4-25)Ni-(2-25)Ce-(0.1-4)Sc-(2-30)Gd;
about Al-(4-25)Ni-(2-25)Ce-(0.1-20)Er-(2-30)Gd;
about Al-(4-25)Ni-(2-25)Ce-(0.1-15)Tm)-(2-30)Gd;
about Al-(4-25)Ni-(2-25)Ce-(0.1-25)Lu)-(2-30)Gd;
about Al-(4-25)Ni-(2-25)Ce-(0.1-25)Yb-(2-30)Gd;
about Al-(4-25)Ni-(2-25)Ce-(0.1-4)Sc-(2-30)Y;
about Al-(4-25)Ni-(2-25)Ce-(0.1-20)Er-(2-30)Y;
about Al-(4-25)Ni-(2-25)Ce-(0.1-15)Tm)-(2-30)Y;
about Al-(4-25)Ni-(2-25)Ce-(0.1-25)Lu)-(2-30)Y;
about Al-(4-25)Ni-(2-25)Ce-(0.1-25)Yb-(2-30)Y;
about Al-(4-25)Ni-(2-25)Ce-(0.1-4)Sc-(0.5-5)Zr;

about Al-(4-25)Ni-(2-25)Ce-(0.1-20)Er-(0.5-5)Zr;
about Al-(4-25)Ni-(2-25)Ce-(0.1-15)Tm)-(0.5-5)Zr;
about Al-(4-25)Ni-(2-25)Ce-(0.1-25)Lu)-(0.5-5)Zr;
about Al-(4-25)Ni-(2-25)Ce-(0.1-25)Yb-(0.5-5)Zr;
about Al-(4-25)Ni-(2-25)Ce-(0.1-4)Sc-(0.5-10)Ti;
about Al-(4-25)Ni-(2-25)Ce-(0.1-20)Er-(0.5-10)Ti;
about Al-(4-25)Ni-(2-25)Ce-(0.1-15)Tm-(0.5-10)Ti;
about Al-(4-25)Ni-(2-25)Ce-(0.1-25)Lu-(0.5-10)Ti;
about Al-(4-25)Ni-(2-25)Ce-(0.1-25)Yb-(0.5-10)Ti;
about Al-(4-25)Ni-(2-25)Ce-(0.1-4)Sc-(0.5-10)Hf;
about Al-(4-25)Ni-(2-25)Ce-(0.1-20)Er-(0.5-10)Hf;
about Al-(4-25)Ni-(2-25)Ce-(0.1-15)Tm-(0.5-10)Hf;
about Al-(4-25)Ni-(2-25)Ce-(0.1-25)Lu)-(0.5-10)Hf;
about Al-(4-25)Ni-(2-25)Ce-(0.1-25)Yb-(0.5-10)Hf,
about Al-(4-25)Ni-(2-25)Ce-(0.1-4)Sc-(0.5-5)Nb;
about Al-(4-25)Ni-(2-25)Ce-(0.1-20)Er)-(0.5-5)Nb;
about Al-(4-25)Ni-(2-25)Ce-(0.1-15)Tm-(0.5-5)Nb;
about Al-(4-25)Ni-(2-25)Ce-(0.1-25)Lu)-(0.5-5)Nb;
about Al-(4-25)Ni-(2-25)Ce-(0.1-25)Yb-(0.5-5)Nb;
about Al-(4-25)Ni-(2-25)Ce-(0.1-4)Sc-(0.5-15)Fe;
about Al-(4-25)Ni-(2-25)Ce-(0.1-20)Er)-(0.5-15)Fe;
about Al-(4-25)Ni-(2-25)Ce-(0.1-15)Tm-(0.5-15)Fe;
about Al-(4-25)Ni-(2-25)Ce-(0.1-25)Lu)-(0.5-15)Fe; and
about Al-(4-25)Ni-(2-25)Ce-(0.1-25)Yb-(0.5-15)Fe.

In the inventive aluminum based alloys disclosed herein, scandium forms an equilibrium $Al_3Sc$ intermetallic dispersoid that has an $L1_2$ structure that is an ordered face centered cubic structure with the Sc atoms located at the corners and aluminum atoms located on the cube faces of the unit cell.

In order to have the best properties for the alloys of this invention, it is desirable to limit the amount of other elements. Specific elements that should be reduced or eliminated include no more that about 0.1 weight percent chromium, 0.1 weight percent manganese, 0.1 weight percent vanadium and 0.1 weight percent cobalt. The total quantity of additional elements should not exceed about 1% by weight, including the above listed impurities and other elements.

These aluminum alloys may be made by rapid solidification processing. The rapid solidification process should have a cooling rate greater that about $10^{3\circ}$ C./second including but not limited to powder processing, atomization, melt spinning, splat quenching, spray deposition, cold spray, plasma spray, laser melting and deposition, ball milling and cryomilling.

More exemplary aluminum alloys of this invention include, but are not limited to (in weight percent):

about Al-(6-20)Ni-(4-20)Ce-(0.1-3)Sc-(4-25)Gd;
about Al-(6-20)Ni-(4-20)Ce-(0.3-15)Er-(4-25)Gd;
about Al-(6-20)Ni-(4-20)Ce-(0.2-10)Tm)-(4-25)Gd;
about Al-(6-20)Ni-(4-20)Ce-(0.3-20)Lu)-(4-25)Gd;
about Al-(6-20)Ni-(4-20)Ce-(0.3-20)Yb-(4-25)Gd;
about Al-(6-20)Ni-(4-20)Ce-(0.1-3)Sc-(4-25)Y;
about Al-(6-20)Ni-(4-20)Ce-(0.3-15)Er-(4-25)Y;
about Al-(6-20)Ni-(4-20)Ce-(0.2-10)Tm)-(4-25)Y;
about Al-(6-20)Ni-(4-20)Ce-(0.3-20)Lu)-(4-25)Y;
about Al-(6-20)Ni-(4-20)Ce-(0.3-20)Yb-(4-25)Y;
about Al-(6-20)Ni-(4-20)Ce-(0.1-3)Sc-(1-4)Zr;
about Al-(6-20)Ni-(4-20)Ce-(0.3-15)Er-(1-4)Zr;
about Al-(6-20)Ni-(4-20)Ce-(0.2-10)Tm)-(1-4)Zr;
about Al-(6-20)Ni-(4-20)Ce-(0.3-20)Lu)-(1-4)Zr;
about Al-(6-20)Ni-(4-20)Ce-(0.3-20)Yb-(1-4)Zr;
about Al-(6-20)Ni-(4-20)Ce-(0.1-3)Sc-(1-8)Ti;
about Al-(6-20)Ni-(4-20)Ce-(0.3-15)Er-(1-8)Ti;
about Al-(6-20)Ni-(4-20)Ce-(0.2-10)Tm-(1-8)Ti;
about Al-(6-20)Ni-(4-20)Ce-(0.3-20)Lu-(1-8)Ti;
about Al-(6-20)Ni-(4-20)Ce-(0.3-20)Yb-(1-8)Ti;
about Al-(6-20)Ni-(4-20)Ce-(0.1-3)Sc-(1-8)Hf;
about Al-(6-20)Ni-(4-20)Ce-(0.3-15)Er-(1-8)Hf;
about Al-(6-20)Ni-(4-20)Ce-(0.2-10)Tm-(1-8)Hf;
about Al-(6-20)Ni-(4-20)Ce-(0.3-20)Lu-(1-8)Hf;
about Al-(6-20)Ni-(4-20)Ce-(0.3-20)Yb-(1-8)Hf;
about Al-(6-20)Ni-(4-20)Ce-(0.1-3)Sc-(1-3)Nb;
about Al-(6-20)Ni-(4-20)Ce-(0.3-15)Er-(1-3)Nb;
about Al-(6-20)Ni-(4-20)Ce-(0.2-10)Tm-(1-3)Nb;
about Al-(6-20)Ni-(4-20)Ce-(0.3-20)Lu-(1-3)Nb;
about Al-(6-20)Ni-(4-20)Ce-(0.3-20)Yb-(1-3)Nb;
about Al-(6-20)Ni-(4-20)Ce-(0.1-3)Sc-(1-10)Fe;
about Al-(6-20)Ni-(4-20)Ce-(0.3-15)Er)-(1-10)Fe;
about Al-(6-20)Ni-(4-20)Ce-(0.2-10)Tm-(1-10)Fe;
about Al-(6-20)Ni-(4-20)Ce-(0.3-20)Lu)-(1-10)Fe; and
about Al-(6-20)Ni-(4-20)Ce-(0.3-20)Yb-(1-10)Fe.

More preferred examples of similar alloys to these are alloys with about 8 to about 15 weight percent nickel and about 6 to about 15 weight percent cerium, and include, but are not limited to (in weight percent):

about Al-(8-15)Ni-(6-15)Ce-(0.2-2.5)Sc-(6-20)Gd;
about Al-(8-15)Ni-(6-15)Ce-(0.5-10)Er-(6-20)Gd;
about Al-(8-15)Ni-(6-15)Ce-(0.4-6)Tm-(6-20)Gd;
about Al-(8-15)Ni-(6-15)Ce-(0.4-10)Lu-(6-20)Gd;
about Al-(8-15)Ni-(6-15)Ce-(0.4-10)Yb-(6-20)Gd;
about Al-(8-15)Ni-(6-15)Ce-(0.2-2.5)Sc-(6-20)Y;
about Al-(8-15)Ni-(6-15)Ce-(0.5-10)Er-(6-20)Y;
about Al-(8-15)Ni-(6-15)Ce-(0.4-6)Tm-(6-20)Y;
about Al-(8-15)Ni-(6-15)Ce-(0.4-10)Lu-(6-20)Y;
about Al-(8-15)Ni-(6-15)Ce-(0.4-10)Yb-(6-20)Y;
about Al-(8-15)Ni-(6-15)Ce-(0.2-2.5)Sc-(1-3)Zr;
about Al-(8-15)Ni-(6-15)Ce-(0.5-10)Er-(1-3)Zr;
about Al-(8-15)Ni-(6-15)Ce-(0.4-6)Tm-(1-3)Zr;
about Al-(8-15)Ni-(6-15)Ce-(0.4-10)Lu-(1-3)Zr;
about Al-(8-15)Ni-(6-15)Ce-(0.4-10)Yb-(1-3)Zr;
about Al-(8-15)Ni-(6-15)Ce-(0.2-2.5)Sc-(1-4)Ti;
about Al-(8-15)Ni-(6-15)Ce-(0.5-10)Er-(1-4)Ti;
about Al-(8-15)Ni-(6-15)Ce-(0.4-6)Tm-(1-4)Ti;
about Al-(8-15)Ni-(6-15)Ce-(0.4-10)Lu-(1-4)Ti;
about Al-(8-15)Ni-(6-15)Ce-(0.4-10)Yb-(1-4)Ti;
about Al-(8-15)Ni-(6-15)Ce-(0.2-2.5)Sc-(1-4)Hf;
about Al-(8-15)Ni-(6-15)Ce-(0.5-10)Er-(1-4)Hf;
about Al-(8-15)Ni-(6-15)Ce-(0.4-6)Tm-(1-4)Hf;
about Al-(8-15)Ni-(6-15)Ce-(0.4-10)Lu-(1-4)Hf;
about Al-(8-15)Ni-(6-15)Ce-(0.4-10)Yb-(1-4)Hf;
about Al-(8-15)Ni-(6-15)Ce-(0.2-2.5)Sc-(1-3)Nb;
about Al-(8-15)Ni-(6-15)Ce-(0.5-10)Er)-(1-3)Nb;
about Al-(8-15)Ni-(6-15)Ce-(0.4-6)Tm-(1-3)Nb;
about Al-(8-15)Ni-(6-15)Ce-(0.4-10)Lu)-(1-3)Nb;
about Al-(8-15)Ni-(6-15)Ce-(0.4-10)Yb-(1-3)Nb;
about Al-(8-15)Ni-(6-15)Ce-(0.2-2.5)Sc-(2-8)Fe;
about Al-(8-15)Ni-(6-15)Ce-(0.5-10)Er)-(2-8)Fe;
about Al-(8-15)Ni-(6-15)Ce-(0.4-6)Tm-(2-8)Fe;
about Al-(8-15)Ni-(6-15)Ce-(0.4-10)Lu)-(2-8)Fe; and
about Al-(8-15)Ni-(6-15)Ce-(0.4-10)Yb-(2-8)Fe.

Although the present invention has been described with reference to preferred embodiments, workers skilled in the art will recognize that changes may be made in form and detail without departing from the spirit and scope of the invention.

The invention claimed is:

1. An aluminum alloy having high strength, ductility, corrosion resistance and fracture toughness, comprising:

an amorphous phase aluminum alloy comprising about 4 to 25 weight percent of nickel and about 2 to about 25 weight percent of cerium;

a coherent $L1_2$ phase comprising:

about 4 to about 25 weight percent nickel and about 2 to about 25 weight percent of cerium, at least one first element selected from the group consisting of about 0.1 to about 4 weight percent scandium, about 0.1 to about 20 weight percent erbium, about 0.1 to about 15 weight percent thulium, about 0.1 to about 25 weight percent ytterbium, and about 0.1 to about 25 weight percent lutetium;

at least one second element selected from the group consisting of about 2 to about 30 weight percent gadolinium, about 2 to about 30 weight percent yttrium, about 0.5 to about 5 weight percent zirconium, about 0.5 to about 10 weight percent titanium, about 0.5 to about 10 weight percent hafnium, about 0.5 to about 5 weight percent niobium, and about 0.5 to about 15 weight percent iron;

the balance substantially aluminum wherein the volume fraction of the amorphous phase ranges from about 50 percent to about 95 percent and the volume fraction of the coherent $L1_2$ phase ranges from about 5 percent to about 50 percent.

2. The alloy of claim 1, comprising no more than about 1 weight percent total impurities.

3. The alloy of claim 1, comprising no more than about 0.1 weight percent chromium, about 0.1 weight percent manganese, about 0.1 weight percent vanadium, and about 0.1 weight percent cobalt.

4. The alloy of claim 1, where the alloy is formed by a rapid solidification process.

5. The aluminum alloy of claim 4, wherein the rapid solidification process has a cooling rate greater that about $10^{3\circ}$ C/second.

6. The alloy of claim 5, wherein the rapid solidification process comprises at least one of powder processing, atomization, melt spinning, splat quenching, spray deposition, cold spray, plasma spray, laser melting and deposition, ball milling and cryomilling.

7. An aluminum alloy having high strength, ductility, corrosion resistance and fracture toughness, comprising:

nickel;

cerium;

at least one first element selected from the group consisting of about 0.1 to about 4 weight percent scandium, about 0.1 to about 20 weight percent erbium, about 0.1 to about 15 weight percent thulium, about 0.1 to about 25 weight percent ytterbium, and about 0.1 to about 25 weight percent lutetium;

at least one second element selected from the group consisting of gadolinium, yttrium, zirconium, titanium, hafnium, niobium and iron; and the balance substantially aluminum wherein the nickel, cerium and aluminum form an amorphous phase such that the volume fraction of the amorphous phase ranges from about 50 percent to about 95 percent and the at least one first element and the at least one second element form a coherent $L1_2$ phase such that the volume fraction of the coherent $L1_2$ phase ranges from about 5 percent to about 50 percent.

8. The alloy of claim 7, wherein the alloy comprises:

about 4 to about 25 weight percent nickel;

about 2.0 to about 25 weight percent cerium;

at least one first element selected from the group consisting essentially of about 0.1 to about 4 weight percent scandium, about 0.1 to about 20 weight percent erbium, about 0.1 to about 15 weight percent thulium, about 0.1 to about 25 weight percent ytterbium, and about 0.1 to about 25 weight percent lutetium; and at least one second element selected from the group consisting essentially of about 2 to about 30 weight percent gadolinium, about 2 to about 30 weight percent yttrium, about 0.5 to about 5 weight percent zirconium, about 0.5 to about 10 weight percent titanium, about 0.5 to about 10 weight percent hafnium, about 0.5 to about 5 weight percent niobium, and 0.5 to about 15 weight percent iron.

* * * * *

UNITED STATES PATENT AND TRADEMARK OFFICE

CERTIFICATE OF CORRECTION

PATENT NO. : 7,875,131 B2
APPLICATION NO. : 12/148458
DATED : January 25, 2011
INVENTOR(S) : Awadh B. Pandey It is certified that error appears in the above-identified patent and that said Letters Patent is hereby corrected as shown below:

Col. 9, Line 12
Insert -- and -- after "weight percent iron;"
Col. 10, Line 23
Delete "essentially of"
Col. 10, Line 29
Delete "essentially of"

Signed and Sealed this
Fifth Day of April, 2011

David J. Kappos
*Director of the United States Patent and Trademark Office*